United States Patent [19]

Ettinger

[11] 4,161,638

[45] Jul. 17, 1979

[54] VACUUM INTERRUPTER LATCH RELEASE MECHANISM

[75] Inventor: Robert H. Ettinger, Pittsfield, Mass.

[73] Assignee: General Electric Company, N.Y.

[21] Appl. No.: 905,168

[22] Filed: May 12, 1978

[51] Int. Cl.[2] ..... H01H 3/30

[52] U.S. Cl. ..... 200/153 SC; 200/325; 74/2

[58] Field of Search ..... 200/153 G, 153 SC, 154, 200/318, 323.5, 327; 74/2

[56] References Cited

U.S. PATENT DOCUMENTS

| | | | |
|---|---|---|---|
| 1,132,772 | 3/1915 | Harris | 200/153 G |
| 1,589,924 | 6/1926 | Atwood | 200/153 G |
| 1,935,428 | 11/1933 | Atwood | 200/153 G X |
| 2,110,568 | 3/1938 | Bush | 74/2 X |
| 2,204,393 | 6/1940 | Atwood | 200/153 G X |

*Primary Examiner*—Charles E. Phillips

*Attorney, Agent, or Firm*—Francis X. Doyle; Richard A. Menelly

[57] ABSTRACT

A vacuum interrupter latch release mechanism employs a pivotably mounted trigger action arm in cooperation with a support arm assembly to resist the force of a main spring until the normally closed interrupter must be opened. Rotating the trigger action arm causes a catch on the trigger arm to become disengaged from an associated stop provided on the support arm assembly and allows the support arm assembly to pivot under the force of the main spring while being resisted by its weaker support spring. The rotation of the support arm is accelerated by the main spring. After a short stroke, an associated linkage impacts a stop on the vacuum interrupter which then becomes opened. The large force of the main spring causes virtually no wearing effect on the catch and stop faces over long periods of continuous operation.

9 Claims, 6 Drawing Figures

F
38A
33
40
41
29
8
32
39
B
36
32
35
37A
41
A
γ
28
29
38
30
9
31
30
34
16
37

VACUUM INTERRUPTER LATCH RELEASE MECHANISM

BACKGROUND OF THE INVENTION

This invention relates to latch release mechanisms for use with vacuum interrupters within transformer tap changer assemblies. The tap changer assembly consists of a tap selector and contactor, with the vacuum interrupter mounted on an insulating panel and connected with a motor drive mechanism. The mechanism is operated through a plurality of gears and cams coupled with the tap-selector assembly. When changing from one tap position to the next the mechanical arrangement of parts coupled to a motor drive temporarily provides interruption of the current in one of two paths by opening the vacuum interrupter contacts.

Atmospheric pressure plus the static insulating oil head pressure keep the vacuum interrupter in its normally closed position. One currently employed interrupter latch mechanism consists of a slideably connected latch and catch arrangement wherein a rectilinear step on the latch assembly retains the catch against the force of the trigger spring. In operation of the latch release cycle, the latch is slideably removed from under the catch so that the trigger spring moves the catch lever as soon as the rectilinear step is clear of the catch. Since the latch assembly moves in a horizontal plane a decreasingly smaller portion of the step must support the entire force of the trigger spring. If trigger spring forces are increased the step assembly could become worn, after long periods of continued use, by the mechanical pressure exerted upon the step during the last few fractions of an inch of motion of the latch release cycle. A catastrophic result could occur when the step portion becomes worn to such and extent as to be incapable of retaining the catch and so causing the vacuum interrupter to become interrupted prematurely.

The purpose of this invention is to provide a vacuum interrupter latch release mechanism wherein the latch assembly remains virtually unworn over an indefinite period of operating time.

SUMMARY OF THE INVENTION

The invention comprises a vacuum interrupter latch release mechanism wherein the trigger action arm carries a catch assembly that is rotatably mounted relative to a pivotably mounted stop. The spring force is mainly supported by a roller mechanism and support arm while only a small portion of the spring force is supported by the catch.

GENERAL CONSIDERATIONS

Figure 1:
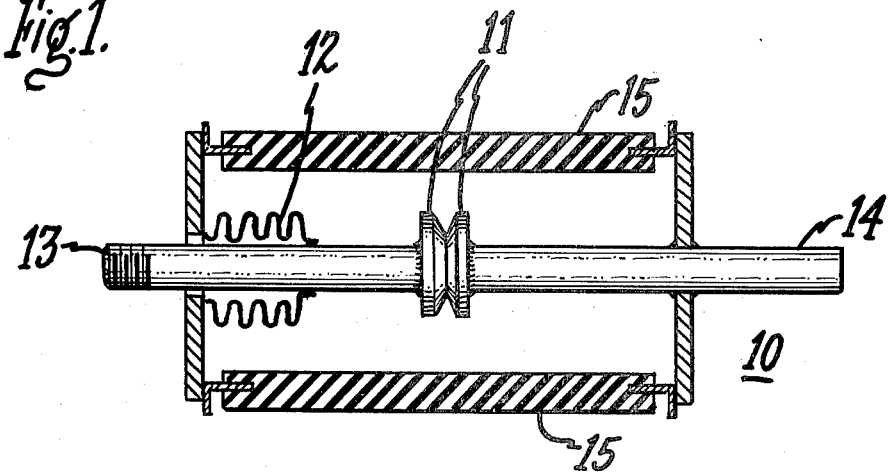
FIG. 1 is a sectional view of a vacuum interrupter for use with the latch release mechanism of the invention.
Figure 2:
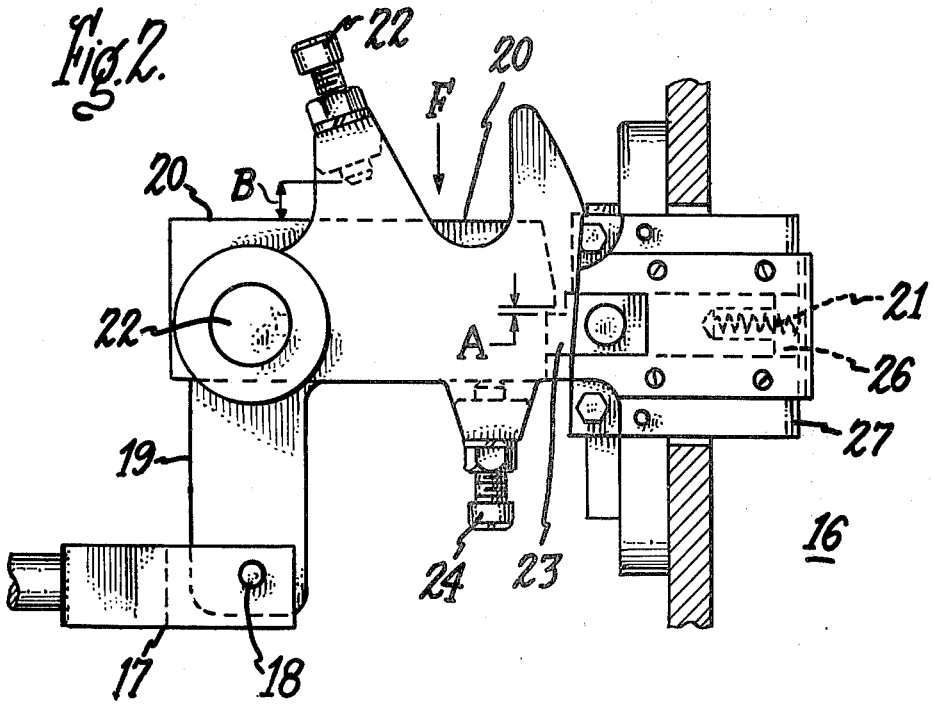
FIG. 2 is a side view in partial section of a latch release mechanism of the prior art.
Figure 3:
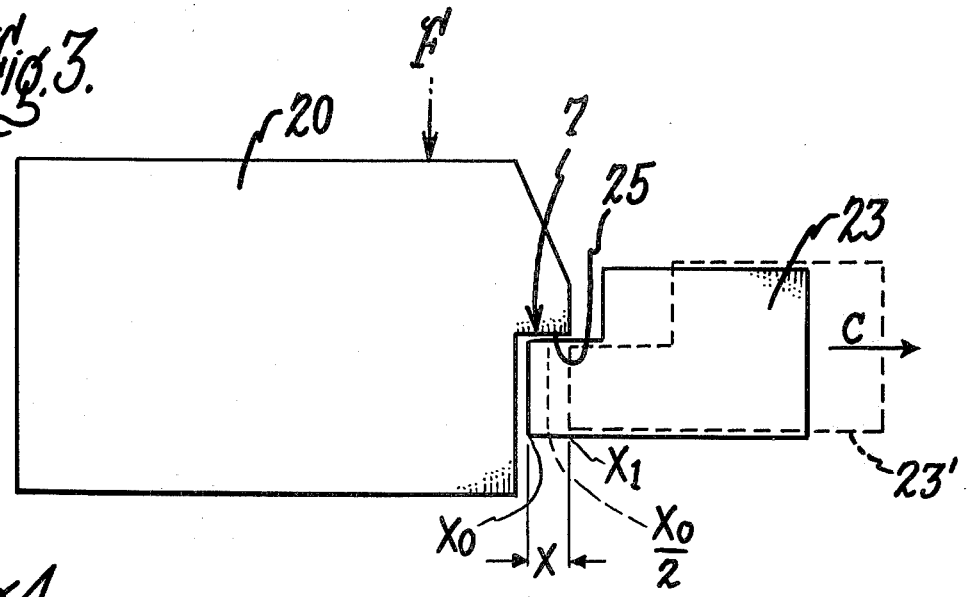
FIG. 3 is an enlarged side view of the catch assembly for the latch release mechanism as now used.
Figure 4:
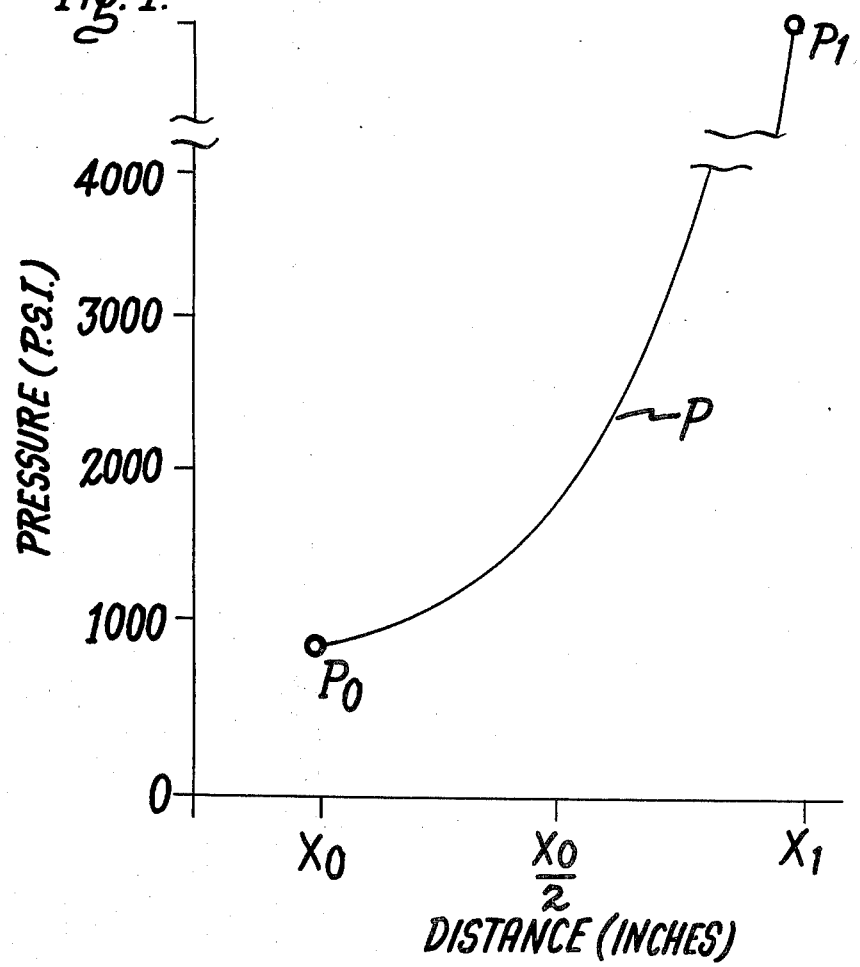
FIG. 4 is a graphic representation of the catch release assembly of FIG. 3 as a function of distance along the latch step and pressure.

The latch release mechanism of the invention is used with a vacuum interrupter 10 of the type shown in FIG. 1 and containing a pair of arcing contacts 11 within a vacuum envelope 15. One contact is attached to a stationary electrical terminal 14 and the other is attached to a movable electrical terminal 13. The flexible bellow 12 allows contact 13 to move relative to envelope 15. When the transformer is in normal operation, the arcing contacts 11 are in contact in order to provide a current path between them. When a tap change is to be made, the vacuum interrupter is used to break the current before changing the tap position. Gas and oil pressure pushing externally on terminal 13 prevent the contacts from becoming inadvertently separated during normal transformer operation. A typical latch release mechanism is shown in FIG. 2 and consists basically of a housing 27 supporting a latch lever 20 and latch 23, wherein the latch is held in contact with the latch lever by means of a spring 21, and wherein the latch slideably moves within a slot 26 within the housing. The latch lever 20 is pivotably connected to a push rod 17 by means of pivot 18 and the push rod is operably connected to a cam. A heavy compression spring (not shown) holds the latch lever 20 in contact with latch 23 by means of a catch 25. The space relationship between catch 25 and latch 23 is adjusted by means of a top adjustment screw 22 and a bottom adjustment screw 24. The tripping arm assembly 19 is operably connected to the latch lever 20 by means of screw 24. The interrupter latch release mechanism 16 operates to separate the vacuum interrupter arcing contacts in the following manner. A moving force is applied to latch 23 in opposition to spring 21 causing the latch to slide within slot 26. As the latch continuously moves away from latch lever 20 catch 25 captures less and less of the latch surface. When the latch 23 is clear of the catch 25 shaft 22 turns rapidly under the action of the aforementioned compression spring and causes the movable electrical terminal 13 of the vacuum interrupter to move in an outward direction so that the arcing contacts 11 become separated to break the circuit connection. As described earlier the latch 23 becomes worn and ineffective for capturing the catch 25 after long periods of operation under very heavy loads. The reason for the wear of latch 23 over long periods of continued use can be seen by referring now to FIG. 3 wherein the latch lever 20 and latch 23 are shown in an enlarged view. In the operation of the latch release process latch 23 is drawn in the direction indicated by arrow C until the step portion 7 of the latch is clear of the catch. The dotted lines indicate the position wherein the displaced latch 23' is separably removed from latch lever 20. The spring force is indicated by the directional arrow F and the pressure relationship in pounds per square inch existing on the surface of step 7 as latch 23 is moved in the direction indicated by arrow C is shown in FIG. 4. The distance X indicates the displacement which occurs between catch 25 and step 7 from where the catch 25 is completely captured by the step to a position where the step is completely free from the catch. The pressure exerted upon the surface of the step is indicated at P and is shown to increase proportionately with a decrease in the distance available on the surface of the step. The displacement indicated in FIG. 3 at $X_0$ corresponds to total capture of the catch by the step and corresponds to the least amount of pressure exerted upon the step. Displacement $X_1$ indicates the smallest portion of the step available for opposing force F just before the latch 23 moves out of captive relationship with latch lever 20. The pressure exerted upon the step at zero displacement $X_0$ is indicated at point $P_0$ and the pressure exerted upon the step at displacement $X_1$ is indicated at point $P_1$. It is to be noted that the pressure $P_1$ is substantially greater than the pressure $P_0$ exerted upon the step prior to disengaging the latch mechanism. In order to substantially lessen the amount of pressure exerted upon the latch mechanism the novel interrupter latch release mechanism of the invention was proposed.

Description of the Preferred Embodiment

Figure 5:
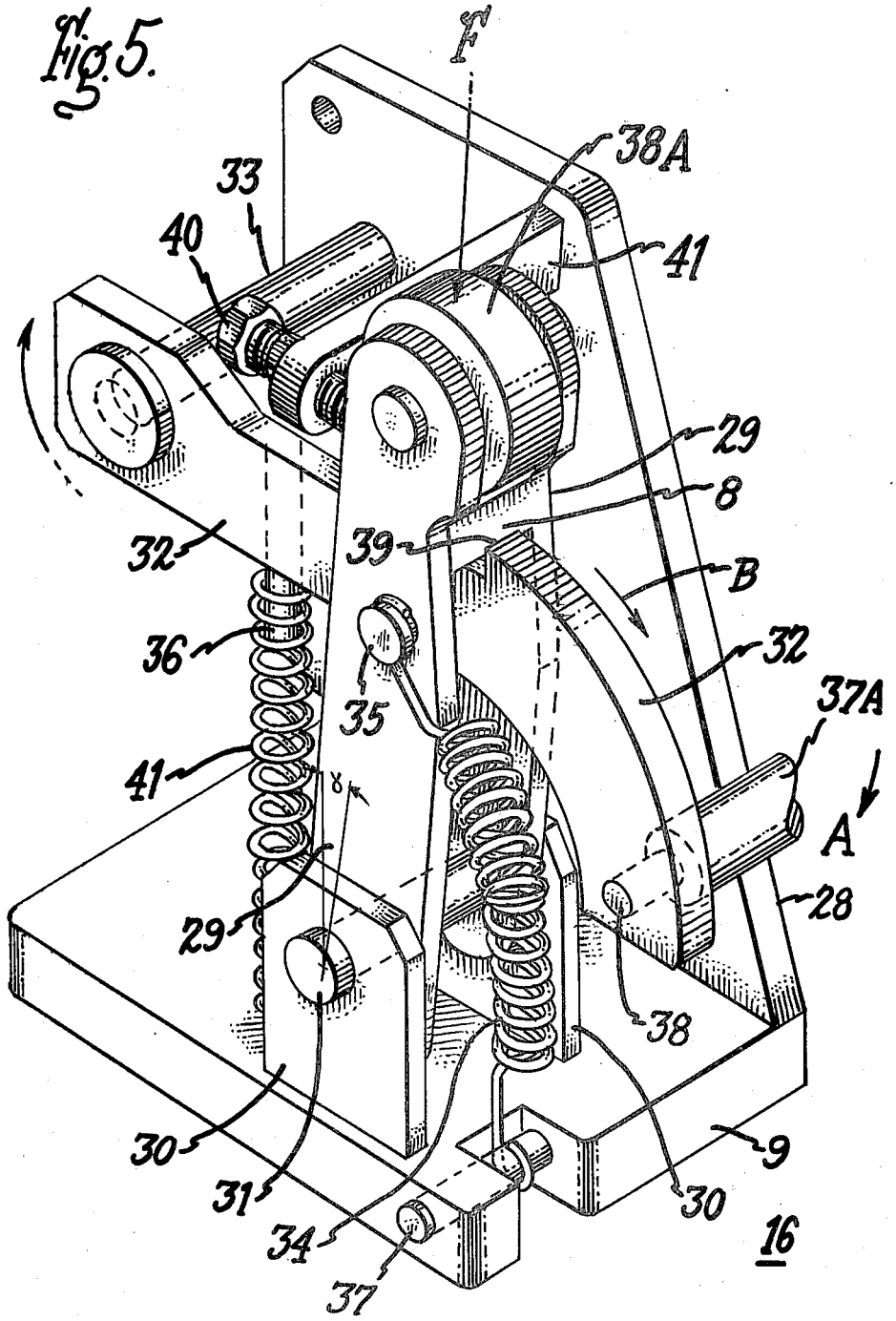
FIG. 5 is a perspective view of one embodiment of the latch release mechanism of the invention.
Figure 6:
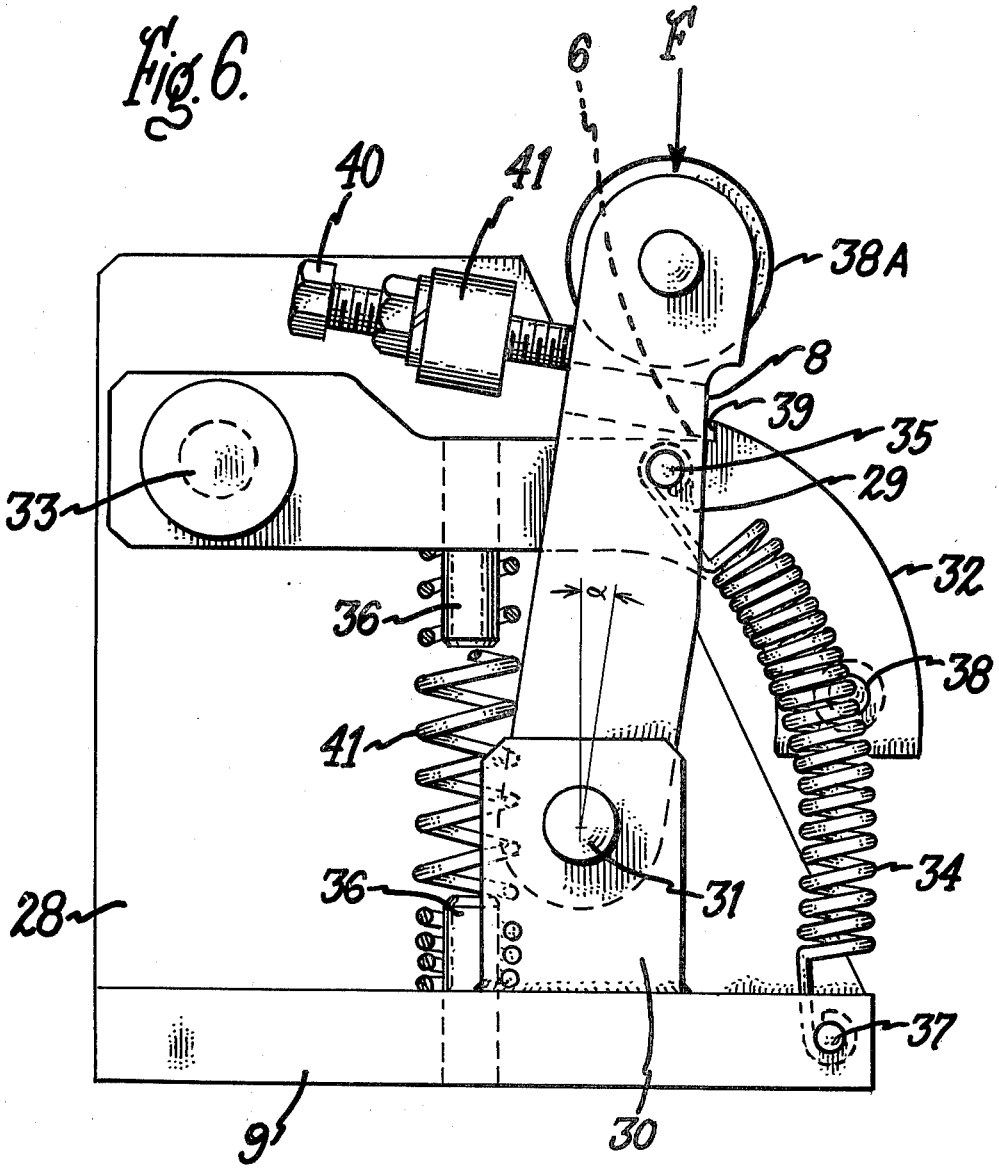
FIG. 6 is a side view in partial section of the mechanism of FIG. 5.

The interrupter latch release mechanism 16 of FIGS. 5 and 6 consists of a base 9 and a support 28 carrying a support arm 29 which is pivotably mounted to the base by means of a pair of support plates 30 and a pivot rod 31. A trigger action arm 32 rotatably connected to the support 28 by means of a pivot rod 33 interacts with the support arm 29 in the following manner. A stop screw 40, prevents spring 34 from pushing arm 29 to top dead center. Spring 34 is fixedly pivoted to arm 29 by pin 35 and to the base 9 by pin 37. The trigger action arm is held in contact with face 6 (FIG. 6) on the support arm by means of a second spring 41. Spring 41 is located by two rods 36 which are pressed within the trigger action arm and the base. At the free end of trigger action arm 32 a rod 37A is attached by means of pin 38. When the main spring exerts force 'F' on roller 38A, support arm 29 rotates clockwise until it is restrained by catch 39 engaging stop face 8. The full force 'F' is now supported mostly by pivot rod 31 and the remainder by the catch 39.

When rod 37A is pushed in direction 'A', the catch 39 will release support arm 29 which will then rotate about pivot 31 in direction 'B'. This releases the energy stored in the main spring. The linkage which opens the vacuum interrupter is accelerated and then impacts on a collar attached to terminal 13. In this way, the contacts 11 are opened at the right time and at the required velocity.

It will be noted that when stop face 8 engages catch 39, the angle $\alpha$ is small. It is for this reason that most of the force F is exerted on pivot 31 and its supporting structure and very little force is exerted on the wearing faces of stop 8 and catch 39. The mechanism is thus able to support and release large forces very precisely without suffering detectable wear.

Although the interrupter latch release mechanism of the invention is described for application with a transformer tap assembly, this is by way of example only. The interrupter latch release mechanism finds application wherever vacuum interrupters may be employed. It also finds application wherever forces have to be supported and released at some precise instant without undue wear.

I claim:

1. A latch release mechanism for operating a moveable electrical terminal comprising:

support means for carrying the latch release mechanism in operational relationship with the terminal;

a trigger action arm pivotally mounted upon the support for retaining electrical contacts in a closed position against a driving force when the trigger action arm is in a first position and for allowing the electrical contacts to open when the trigger action arm is in a second position;

a support arm assembly pivotally connected to a base portion of the support by means of a pair of upright plates at one end and having means on the other end for opposing the force and keeping the electrical contacts in the closed position and for releasing the force to open the electrical contacts in cooperation with said trigger action arm;

a catch means on the trigger action arm for engaging with a stop means on the support arm assembly; and a first spring pivotally attached at one end to the support arm assembly proximate the stop means and pivotally attached at the other end to the base support.

2. The latch release mechanism of claim 1 wherein the support arm assembly includes a support arm held in contact with the stop means by means of a first spring.

3. The latch release mechanism of claim 1 wherein the trigger action arm is held in contact with the support arm assembly by means of a second spring.

4. The latch release mechanism of claim 1 wherein the opposing force means comprises a roller rotatably attached to the support arm assembly.

5. The latch release mechanism of claim 1 wherein the stop means comprises a portion of the support arm assembly.

6. The latch release mechanism of claim 1 wherein the catch means comprises a step portion on the trigger action arm.

7. The latch release mechanism of claim 1 further including a setscrew assembly for providing adjustment between the trigger action catch and the support assembly stop.

8. The latch release mechanism of claim 7 wherein the setscrew assembly is fixedly attached to the support at one end.

9. A latch release mechanism for operating a moveable electrical terminal comprising:

support means for carrying the latch release mechanism in operational relationship with the terminal;

a trigger action arm pivotally mounted upon the support for retaining electrical contacts in a closed position against a driving force when the trigger action arm is in a first position and for allowing the contacts to open when the trigger action arm is in second position;

a support arm assembly pivotally connected to the support at one end and having means on the other end for opposing the force and keeping the contacts in the closed position and for releasing the force to open the contacts in cooperation with said trigger action arm;

a rod connected at one end of the trigger action arm for causing the trigger arm to move in a rotatable manner around a pivot; and a spring retained by a first concentric pin connected to the trigger action arm and a second concentric pin connected to the base.

* * * * *